United States Patent [19]

Wilkinson

[11] 4,098,492

[45] Jul. 4, 1978

[54] QUICK CHANGE TRAVELING BLOCK

[75] Inventor: Alvin H. Wilkinson, Talala, Okla.

[73] Assignee: Auto Crane Company, Tulsa, Okla.

[21] Appl. No.: 767,797

[22] Filed: Feb. 11, 1977

[51] Int. Cl.[2] ..... B66D 3/08

[52] U.S. Cl. ..... 254/189; 254/197

[58] Field of Search.....254/192, 193, 197, 188, 189

[56] References Cited

U.S. PATENT DOCUMENTS

| | | | |
|---|---|---|---|
| 276,561 | 5/1883 | Clark | 254/188 X |
| 2,728,552 | 12/1955 | Fate, Jr. | 254/197 |
| 2,800,300 | 7/1957 | Johnson et al. | 254/197 X |
| 3,936,034 | 2/1976 | Larralde | 254/188 |

FOREIGN PATENT DOCUMENTS

| | | | |
|---|---|---|---|
| 1,261,966 | 2/1972 | United Kingdom | 254/188 |

*Primary Examiner*—Drayton E. Hoffman

*Assistant Examiner*—Donald W. Underwood

*Attorney, Agent, or Firm*—Head, Johnson & Chafin

[57] ABSTRACT

A travelling block system that can be changed quickly from a four support line system to a two support line system, which comprises a travelling block having two sheaves, and a single sheave block with hook, attached to the crown of a boom. The two sheave travelling blocks comprise a frame with two parallel spaced plates serving as inner sheave plates, two sheaves on the outside of the inner sheave plates, and two outer sheave plates. The sheave plates are firmly bolted to the frame, and appropriate sheave pins are supplied through each pair of outer and inner sheave plates. Two guard strips are provided which are removably attached around the periphery of the outer and inner sheave plates so as to completely contain the cable around the sheave on sides and bottom of the sheaves.

2 Claims, 7 Drawing Figures

QUICK CHANGE TRAVELING BLOCK

CROSS-REFERENCE TO RELATING APPLICATION

This invention is related to the copending application Ser. No. 767,806 entitled Safety Becket filed on the same date as this application, which illustrates a particular kind of a crane becket that is very well adapted for use with this invention.

BACKGROUND OF THE INVENTION

1. Field of the Invention

This invention lies in the field of hoisting equipment. More particularly it relates to the design of a hoisting system that can be converted quickly from a four line travelling block, to a two line travelling block without having to detach and rethread the cable through the blocks.

2. Description of the Prior Art

In the prior art there are hoisting systems that require a four line travelling block because of the lifting requirements, while at other times, they could use a two line travelling block because the lifting requirements were reduced, but the speed requirements were increased. In order to do this, it was generally necessary to detach the dead line and restring the cable out of the four line block into a two line block, and so on, and then to reattach the dead line to the boom. This requires a considerable amount of time and difficulty and which limited its use, whereas a simpler system, such as the present invention, might well have been put to use on many occasions.

SUMMARY OF THE INVENTION

It is a primary object of this invention to provide a travelling block hoisting system containing a two sheave block and hook, and a one sheave block and hook, permanently threaded with cable between the winch and the dead line.

It is another important object of this invention to quickly change the system from a four line travelling block to a two line, travelling block, which can, of course, travel at twice the speed of the four line travelling block.

These and other objects are realized and the limitations of the prior art are overcome in this invention by having a four line, two sheave, block which is of such a design that the cables are not captured in the sheaves, and do not have to be threaded around the sheaves as is customary. The block is designed with a frame and two sheaves, mounted one on each side. There are inner and outer sheave plates which have vertical sides and semicircular bottoms of slightly larger radius than that of the sheave, so that a curved strip of metal can be placed around and locked to the edges of the sheave plates, providing a complete guard around the sides and bottom of the sheaves.

Thus by lowering the travelling block and hook to the ground, unclipping and removing the guard strips, the cable can be unlooped from the two sheaves, and since it was previously threaded through a single sheave block and hook, the hook of which was attached to the boom, the two lines, the dead line and live line, now go only to the single sheave block. The reverse operation is to lay the single block on the ground with the two lines coming from the single sheave, loop them around the two sheaves on the two sheave blocks, hook the one sheave block to the boom and replace the guard strips around the two sheaves and this system is now a four line sheave system.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
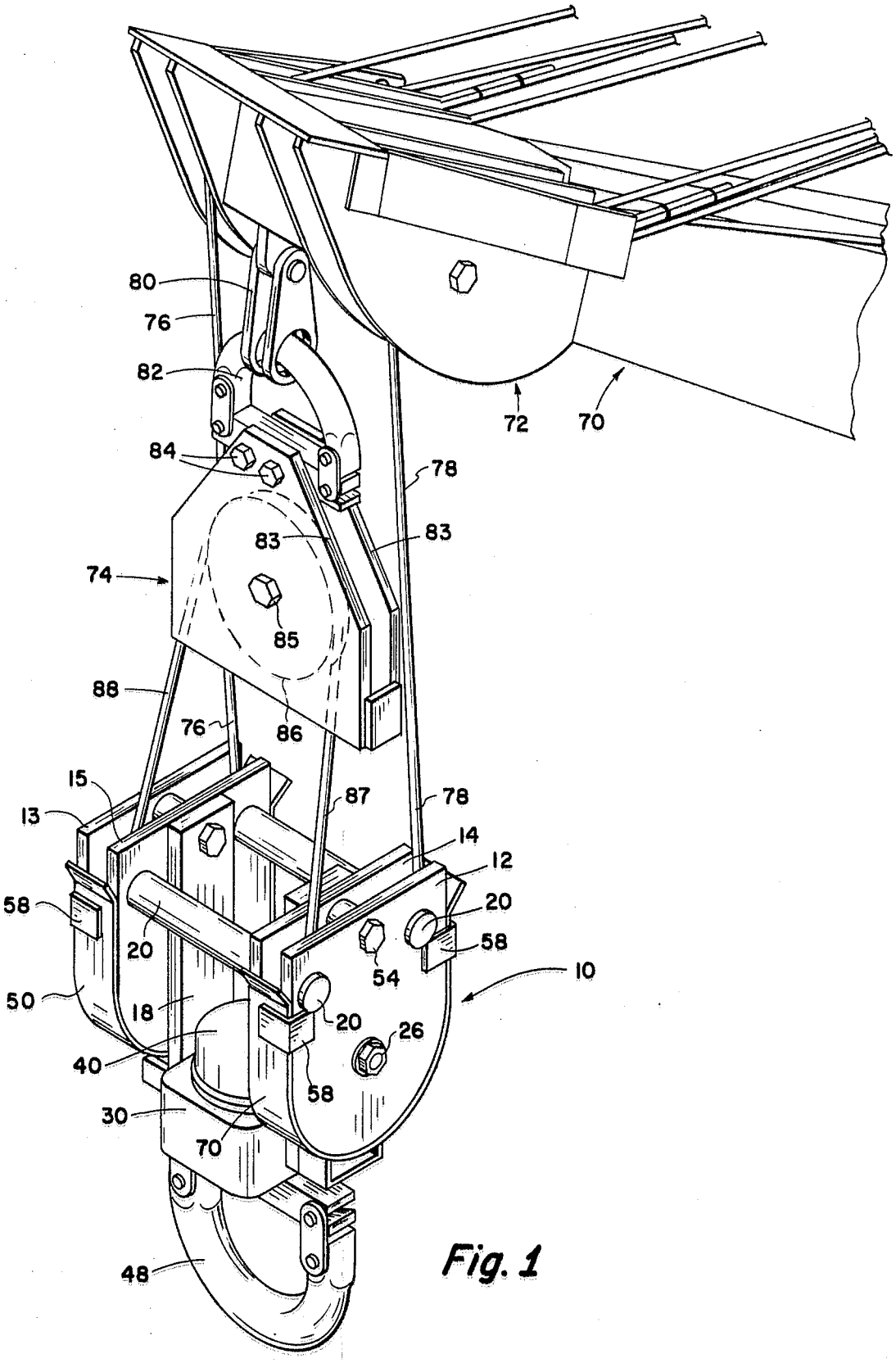
FIG. 1 illustrates one embodiment of this invention.

Referring now to the drawing and in particular to FIG. 1, there is shown a travelling block having a frame including two parallel, spaced parallel sheaves, and a swivel and hook, indicated generally by the numeral 10. There is a single sheave block indicated generally by the numeral 74, having a hook 82. The live line 78 from the drum (not shown) is carried over a crown sheave indicated generally by the numeral 72 mounted at the end of a crane boom indicated generally by the numeral 70. The live line 78 is looped from the crown sheave 72 under one of the sheaves 24 on the travelling block, and as line 87 up and over the single sheave 86 in the single sheave block 74, then down as line 88 and under the second sheave 25 of the travelling block, and up as the dead line 76 to an attachment point on the boom 70. The hook 82 of the single sheave block is supported by means 80 from the crown of the crane boom 70.

The particular feature of this invention that is important is the use of two sheaves 24, 25 and sheave plates 12, 14 and 13, 15 which are designed with quickly removable guard strips 50, which surround the sides and bottom of the sheave plates 12 and 14 on one side and 13 and 15 respectively on the other side of the travelling block.

The travelling block 10 will be described in full detail in connection with FIGS. 2, 3 and 4. The purpose of FIG. 1 is to illustrate the manner in which the two blocks are used in order to provide a quick change from a four supporting line block system to a two supporting line block system.

Figure 5:
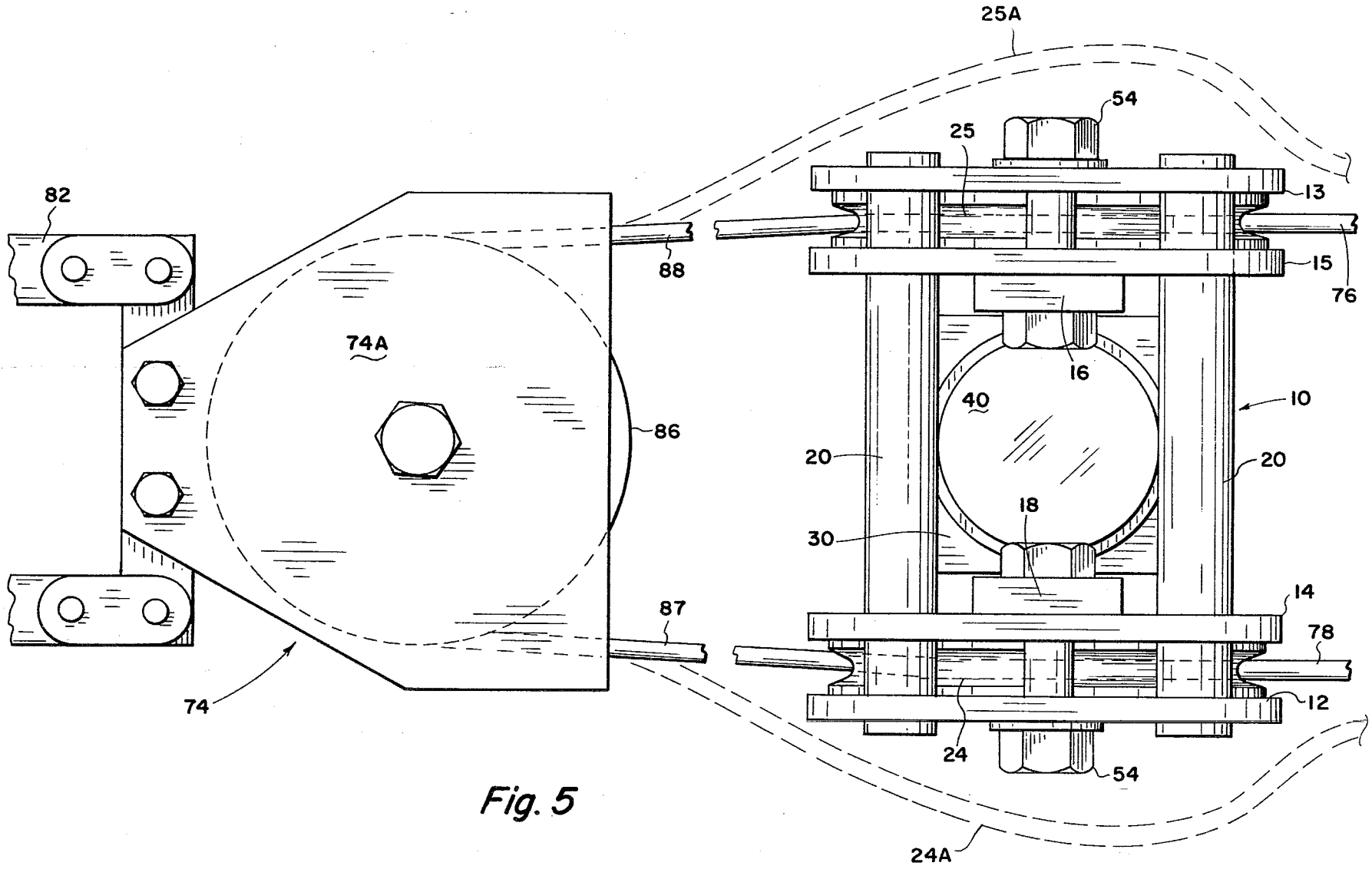
FIG. 5 illustrates the process of changing from a four line block to a two line block.

Consider in FIGS. 1 and 5 that the boom 70 is lowered so that the travelling block 10 is resting on the ground. The single block 74 is then unhooked, by passing the hook 82 out of the links 80, which support it from the boom. The single block is then layed out on the ground with the cables 87 and 88 in direct line with the sheaves 24 and 25 of the travelling block 10. The sheave guards 50 which are normally fastened around the sheave plates 12 and 14 on one side and 13 and 15 on the other, are slipped out of the clips 58 and removed from around the sheaves, which in FIG. 1 are not visible since they are hidden by the sheave plates. Once the sheave guards, or guard strips 50 are removed, the cable can be carried over the outer sheave plates and laid on the ground as shown by dashed lines 24A, 25A. In that case the live line 78 from the crown sheave then goes directly as line 87 to the single sheave block 74 and as line 88 then leaves the single sheave block and as line 76 becomes the dead line which is attached to the boom. The cables then are connected solely with the single sheave block 74 as a two supporting line block, for more rapid lifting and lowering operations.

When a heavier load is to be lifted, the reverse operation is carried out. That is, the boom is lowered over the position of the travelling block 10 which is on the ground. The single sheave block 74 is lifted and hooked into the links 80, which are supported by the crown on the boom 70. The cable 87, 78 is then looped around the first sheave 24 between the sheave plates 12 and 14, and the guard 50 is put in place behind the clips 58. Similarly the cable 88, 76 is then looped around the second sheave 25 between the sheave plates 13 and 15, and the guard strip 50 is placed around the sheave plates and locked by means of the clips 58. The system is now ready for operation as a four support line travelling block system. Because of the simplicity of the changeover operations and the rapidity with which they can be carried out, the crane boom can then be used much more effectively by choosing one of the two operating systems, which best fit the type of load being lifted at the time.

Figures 2, 2A, 2B:
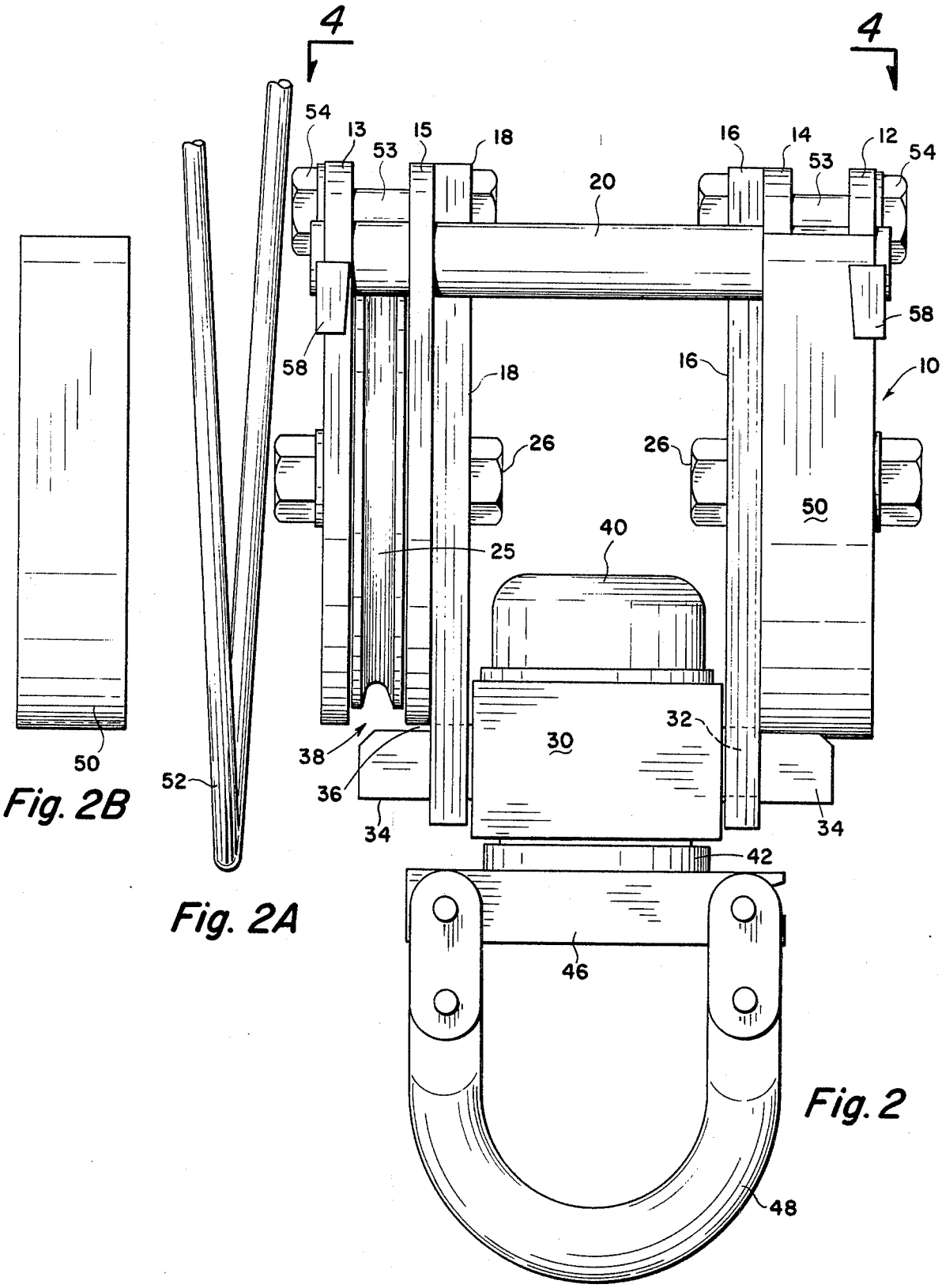
FIGS. 2, 2A, 2B and 3 show elevation views from two sides of the travelling block of FIG. 1.
Figure 3:
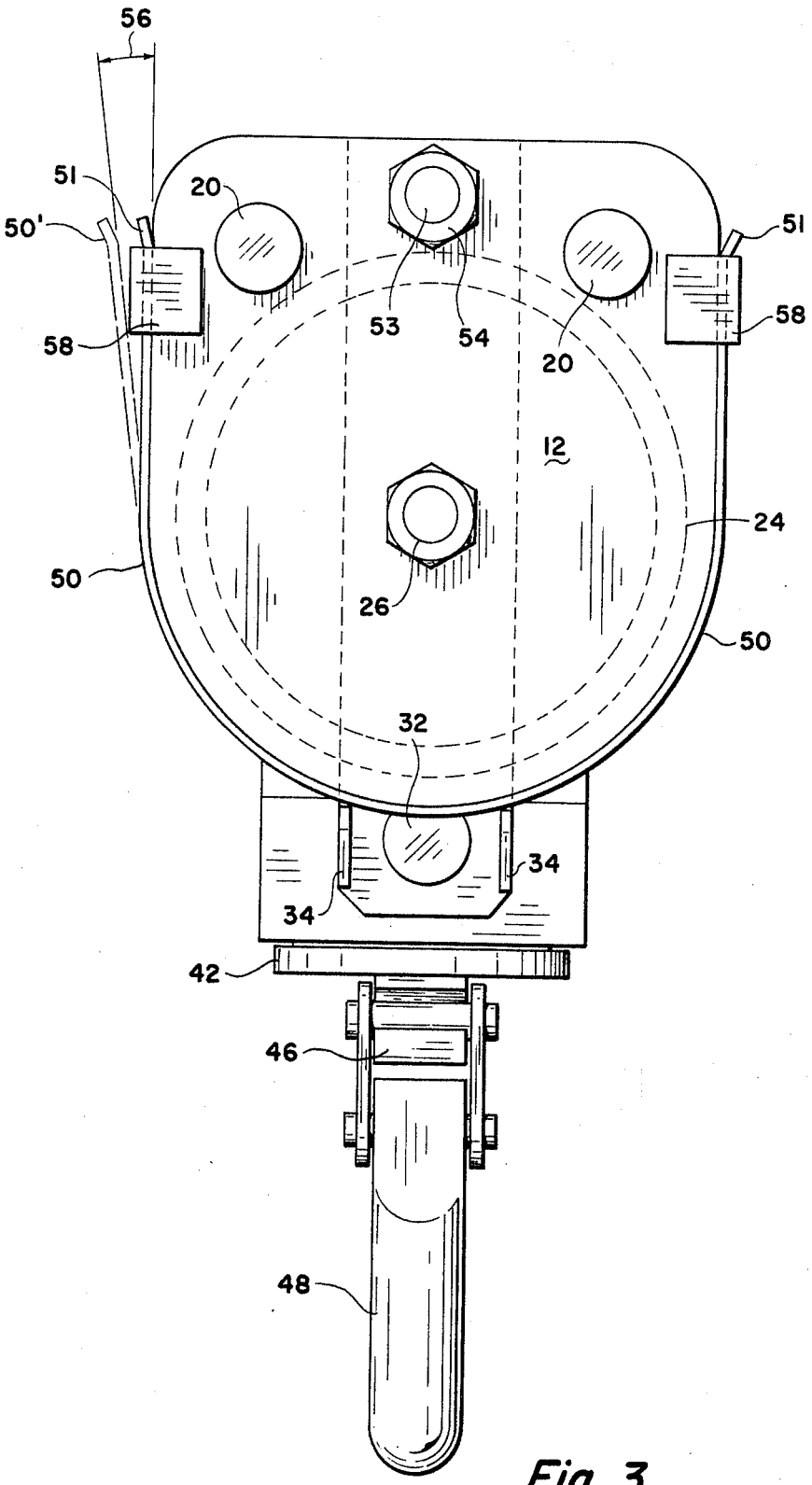
Figure 4:
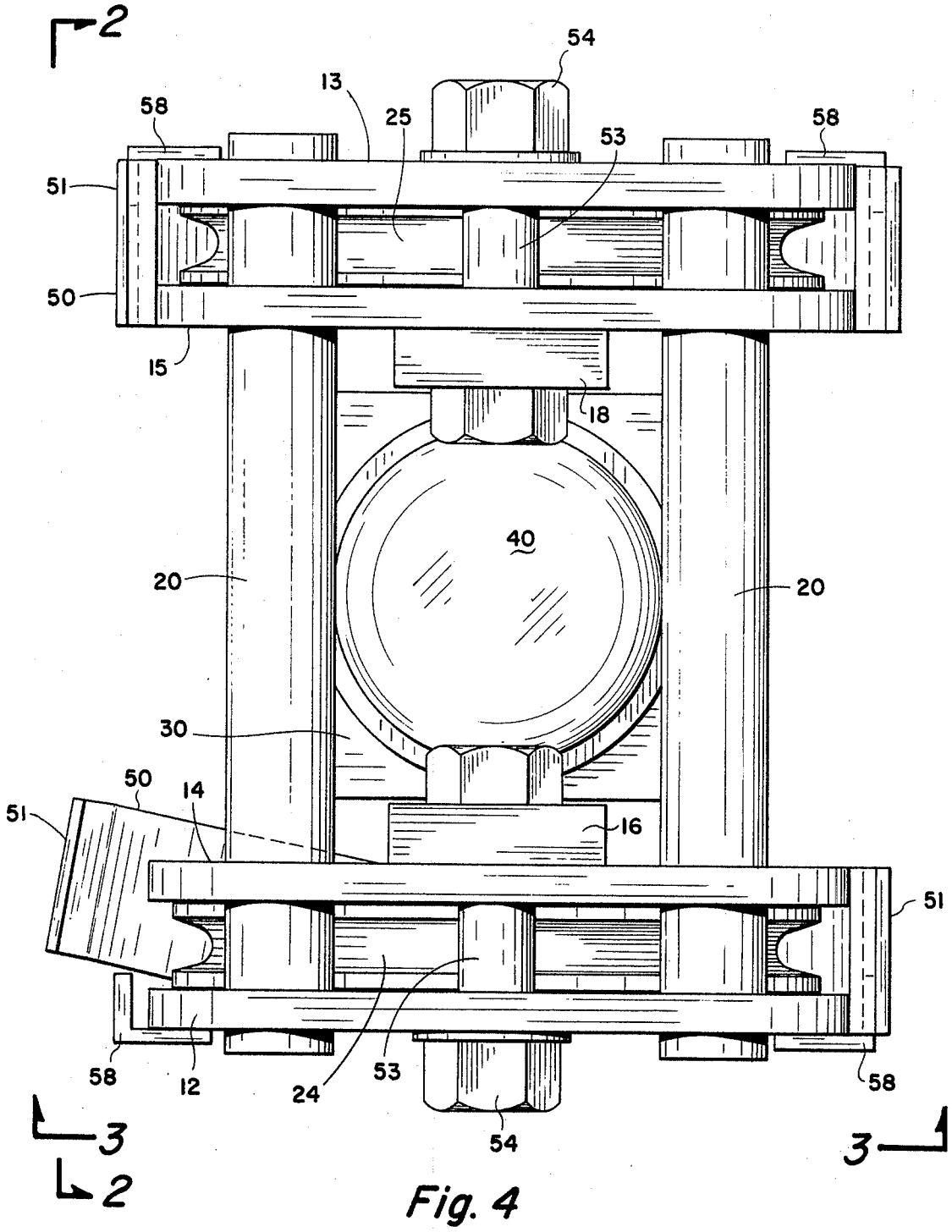
FIG. 4 shows a top view of the travelling block of FIG. 1.

Referring now to FIGS. 2, 3 and 4 there are shown detailed views of the two sheave travelling block 10. FIG. 2 shows an elevation view taken across the plane 2—2 of FIG. 4. FIG. 3 shows an elevation view taken across the plane 3—3 of FIG. 4. FIG. 4 shows a plan view taken across the plane 4—4 of FIG. 2.

There are two spaced apart sheaves 24 and 25 which are supported by sheave pins 26 between inner and outer sheave plates which are indicated by numerals 14 and 12 respectively on the right side of FIG. 2 and 15 and 13 respectively on the left side of FIG. 2. There are also two trunion support bars 16, 18 which are vertical bars placed along side of the inner sheave plates 16 against the sheave plate 14 on the right side and 18 placed along side the inner sheave plate 15 on the left side. The trunion support bars 16 and 18 are attached strongly to the inner and outer sheave plates by means of bolts 53 and nuts 54 as shown in FIGS. 3, 4 and 5. The sheave pins 26 also pass through the trunion support bars 16, 18.

There are two horizontal plate support bars 20 which, with appropriate spacers, pass through the inner and outer sheave plates on both sides of the block. The frame might be said to comprise the two sets of inner and outer sheave plates, the trunion support bars and the horizontal plate support rods 20, all of which together provide a rigid framework.

The trunion support bars 16, 18 support means of shaft extensions 32 the trunion 30 which is a square block having a central vertical opening, carrying a swivel 40, with appropriate thrust bearings, as is well known in the art. The lower end of the swivel 40 comprises a horizontal plate 42, to which is attached a horizontal bar 46, from which hangs a hook 48, which is of the design that is fully described in copending application Ser. No. 767,806 previously mentioned. While the type of hook 48 illustrated is believed to be ideal for this application, it will be clear that the design of this travelling block system does not require this type of hook.

Any appropriate type of trunion, swivel and hook, can be provided as is well known in the art. As a matter of fact, any type of frame can be used that provides adequate strength to two parallel spaced-apart sheaves, with sheave plates and guard strips such that the sheave can be fully enclosed on all sides except the top, for the prevention of injury to personnel and to prevent accidental removal of the cable from the sheave.

As shown in FIGS. 2 and 3, there is a selected small clearance 36 between the support lugs 34 and the inner sheave plate 15, for example, providing a gap 36 into which the curved metal strap, or elongated guard plate 50 can be inserted. This is shown more clearly in FIG. 3, where the contour of the sheave plate is such, and the contour of the support lugs is such, that the small aperture 36 snuggly holds the guard strip 50 in contact with the bottom edges of the sheave plates.

The upper ends of the guard strip 50 are bent out slightly at the top end so that they can be handled more readily, and are normally kept hooked behind the clips 58.

By referring to FIG. 4, it is seen that the guard strip 50 is flexible enough so that when it is hooked into the aperture 36, it can be deflected as shown in FIG. 4, wrapped around the contour of the outer and inner sheave plates, and then hooked under the clip 58 as is shown on the bottom side of FIG. 4 and is shown in FIG. 3. This flexibility of the strips 50 and the use of the clips make a firm attachment for the guard strips, which also provides very rapid removal and attachment.

Shown in FIG. 2A is a loop of the cable indicated by numeral 52 that would be slipped over the outer sheave plate 13 and through the gap 38 between the outer sheave plate 13 and the support lug 34 and looped around the sheave 24. Then the guard strip 50 of FIG. 2B would be put in place through the aperture 36 and then locked behind the clips 58. It is pointed out that the guard strip is pressed up against the shoulder at the support bar on the inside, deflected to the inside as shown in FIG. 4, and then locked behind the clips 58, which prevent its movement outwardly at the top. Thus, there is no tendency or no possibility, except by manual means to remove the guard strip from its position shielding the sheaves. This three point locking of the guard strip provides secure positioning of the guard strips. FIG. 2B is a view of the guard strip 50.

Referring now to FIG. 5, there is shown in schematic fashion, a plan view of the earth, with the travelling block 10, having on one side the outer and inner sheave plates 12 and 14 with sheave 24 and on the other side outer and inner sheave plates 13 and 15, with sheave 25. Stretched out on the ground spaced from the travelling block 10 is the single block sheave 74A and a hook 82.

The cable 78 on the live line now passes under the sheave 24 on the ground and as line 87 passes around the sheave 86 and as cable 88 passes along the ground and under the sheave 25, then as dead line 76 goes up to the crown. In this position the cable which lies on the ground as shown by dashed lines 24A, 25A can be placed under the sheaves 24 and 25 and enclosed by placing the guard strips 50 around each sheave, 24, 25. The hook 82 of sheave 74 is then attached to the boom. Then as the cable 78 is winched in, the block 10 will then be in position, with its hook 48 hanging down, ready for operation as a four line travelling block. To provide a two line travelling block the reverse operations are carried out.

What has been described is a sheave system including a two sheave travelling block and a single sheave block, which, in combination, can be used as a four support line block system and by a quick change, can be converted to a two support line block system.

Also described in detail is an advance design of a two sheave block having a particularly advantageous form, in which the guard strips are quickly removable, so that cables are not captured in the block, but can be inserted and removed by simply being looped over the sheaves.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A quick change four-line to two-line travelling block system for support from the crown of a boom, comprising:

(a) a two sheave block means comprising:

(1) a frame including two spaced, parallel, vertical support bars supporting a swivel between said bars and a first hook;

(2) said frame supporting two vertical, spaced, parallel inner sheave plates outside of said bars, two sheaves outside of said inner sheave plates, and two outer sheave plates outside of said sheaves, said sheaves supported on appropriate sheave pins passing through said sheave plates;

(3) two guard strips, one each adapted to be removably supported by said sheave plates and to enclose the sides and bottom of each sheave; said guard strips being retained independently of any other removable structure;

whereby the guard strips can be removed and cables looped over the sheaves or removed therefrom over the outer sheave plates without removing any other part of said block;

(b) a single sheave block and a second hook, and means to removeably attach said hook to said crown; and (c) means to loop the line from a winch drum over a crown pulley; then under a first sheave of said four-line travelling block, then over said single sheave block, then under the second sheave of said four-line travelling block, and to an attachment point on said boom.

2. In a hoisting system having a two sheave four line travelling block, having removable guard strips enclosing the sides and bottoms of said two sheaves, and a swivel and first hook;

and a single sheave two-line travelling block with a second hook, said second hook removably attached to the crown of a boom; and a cable threaded from a winch drum over a crown sheave, under one sheave of said two sheave blocks, up and over said one sheave block, down and under the second sheave of said two sheave block, and up as a dead line to said boom;

the method of changing from the four line travelling block to the two line travelling block comprising the steps of:

(a) lowering said boom so that said two sheave travelling block rests on the ground;

(b) removing said guard strips;

(c) removing said second hook from said crown, and;

(d) removing said cables out from under said two sheaves of said two sheave travelling block;

whereby said cable system now operates as a two support line travelling block system.

* * * * *